US005325831A

United States Patent [19]

Handa

[11] Patent Number: 5,325,831

[45] Date of Patent: Jul. 5, 1994

[54] CENTRIFUGAL GOVERNOR FOR FUEL INJECTION PUMP

[75] Inventor: Shizuo Handa, Kariya, Japan

[73] Assignee: Nippondenso Co., Ltd., Kariya City, Japan

[21] Appl. No.: 99,571

[22] Filed: Jul. 30, 1993

[30] Foreign Application Priority Data

Jul. 31, 1992 [JP] Japan ..... 4-205696
Jul. 27, 1993 [JP] Japan ..... 5-185068

[51] Int. Cl.[5] ..... F02D 31/00
[52] U.S. Cl. ..... 123/373; 123/365
[58] Field of Search ..... 123/365, 370, 371, 373

[56] References Cited

U.S. PATENT DOCUMENTS

| | | | |
|---|---|---|---|
| 3,577,968 | 5/1971 | Staudt et al. | 123/373 |
| 4,000,728 | 1/1977 | Kurokawa | 123/373 |
| 4,308,833 | 1/1982 | Makino | 123/373 |
| 4,479,474 | 10/1984 | Djordjevic et al. | 123/373 |
| 4,706,627 | 11/1987 | Eltze et al. | 123/373 |
| 4,796,581 | 1/1989 | Brühmann | 123/373 |
| 4,802,451 | 2/1989 | Takahashi | 123/373 |

FOREIGN PATENT DOCUMENTS

| | | |
|---|---|---|
| 528449 | 3/1977 | Japan . |
| 60-119366 | 6/1985 | Japan . |

*Primary Examiner*—E. Rollins Cross
*Assistant Examiner*—Thomas N. Moulis
*Attorney, Agent, or Firm*—Cushman, Darby & Cushman

[57] ABSTRACT

The governor of the present invention includes the reverse Angleich lever 9 one end of which is jointed to the control block 5 which moves in the axial direction in accordance with the movement of the fly weight 3, and the other is jointed to the mid-portion of the control lever 18. At the mid-portion of the reverse Angleich lever 9, there is provided the stopper pin 25, and on the tension lever 12, there is provided the abut member 26 for detachably abutting to the stopper pin 25.

When the cam shaft 2 rotates at a high speed, the stopper pin 25 abuts to the abut member, avoiding the rotation of the reverse Angleich lever 9. Thus, the reverse Angleich characteristic can be obtained.

6 Claims, 9 Drawing Sheets

BEFORE START OF ENGINE

IDLING AND REGULAR DRIVING STATE

AT START OF ENGINE

IDLING

DRIVING AT HIGH SPEED

CENTRIFUGAL GOVERNOR FOR FUEL INJECTION PUMP

BACKGROUND OF THE INVENTION

Field of the Invention

The present invention relates to a centrifugal governor provided in a fuel injection pump for automatically adjusting the injection characteristics in accordance with the driven status of the internal combustion engine, in which the fuel injection pump is provided for supplying fuel thereto.

Description of the Related Art

In a fuel injection pump for supplying fuel with an internal combustion engine, it is required to adjust the injection quantity of fuel in accordance with the driven status of the engine. For such a fuel injection pump, a centrifugal governor (mechanical governor) is employed for automatically controlling the injection characteristic.

Conventionally, there are several types of governors of the above-described kind, and a well-known example is the RSV type governor. The RSV type governor is characterized in utilizing the centrifugal force of the fly weight, using a swiveling lever, and being able to be applied to the speed in all range. In the RSV governor, the fly weight is driven by the centrifugal force of the rotation of the engine, and the displacement of the weight is converted into the linear motion of the control block. Further, the linear motion is adjusted by means of a guide lever, a swiveling lever, a tension lever, a control lever, etc., and propagated to the control rack, which automatically controls the fuel injection quantity of the fuel injection pump.

Recently, the regulation of gaseous emission is becoming more strict as a requirement of the society, and accordingly, the fuel injection pump needs to be performed at a higher pressure than before. A high pressure injection of fuel improves the atomization efficiency, the mixing characteristic with respect to air, so that the combustion efficiency is improved.

However, if fuel is injected at a high pressure, it is likely that a pulsation pressure is created in the injection pipe after the completion of the injection. In order to prevent such a drawback, for example, a constant pressure valve (CPV) is provided at the discharge outlet of the pump, as disclosed in Jpn. Pat. Appln. KOKAI Publication No. 60-119366.

In the case of the hole type fuel injection nozzle, the diameter of the injection hole is reduced, the diameter of the plunger of the fuel injection pump is increased, and/or the profile of the pump-driving cam is changed in order to achieve a high pressure injection.

Regarding the general fuel injection mechanism, in the case where the number of revolution of the fuel injection pump is low, the fuel injection quantity is small, and as the number of revolution rises, the injection quantity increases. In contrast, regarding the CPV-employed fuel injection mechanism, an injection characteristic reverse to the general injection mechanism where a CPV is not employed, is created. More specifically, in the case where the number of revolution of the fuel injection pump is low, the fuel injection quantity is large, and as the number of revolution rises, the injection quantity decreases.

Thus, with the CPV-employed fuel injection mechanism, or the injection mechanism employing an injection nozzle having a squeezed injection hole, it is difficult to achieve a high injection pressure high enough to satisfy the engine full performance characteristic.

In particular, the conventional RSV type governor applicable to a diesel engine for construction machines, includes a torque spring for preventing the engine stopping due to a drastic variance of load, and has a positive Angleich governor characteristic such as indicated by the line (h) shown in FIG. 4. A positive Angleich characteristic acts to adjust the control rack in the direction for reducing the fuel injection quantity in a high speed side.

If an RSV governor having a positive Angleich characteristic, is used in the fuel combustion mechanism employing a CPV such as described above, the fuel injection quantity is further decreased in a high speed drive range, and therefore it becomes impossible to perform a high pressure injection in terms of the gaseous emission regulation (for example, $NO_x$, In the case of a fuel injection mechanism such as a diesel engine for construction machines, which has a fuel injection pump with a CPV, not an RSV type governor having a positive Angleich characteristic, but a governor having an Angleich characteristic reverse to that of the RSV type, such as indicated by the broken line in FIG. 4 is required.

Conventionally, there are governors other than the RSV type, and having reverse Angleich characteristics. For example, the governor disclosed in Jpn. Pat. Appln. KOKOKU Publication No. 52-8449 has a reverse Angleich characteristic. However, if the structure of this governor is applied to an RSV type, the lever ratio ($k_1$) cannot be set at high enough. If the lever ratio ($k_1$) of the reverse Angleich is increased, the adapter screw section and the Angleich holder section overlap with each other.

Further, with the conventional reverse Angleich governor employed in an automobile diesel engine, the amount of moving the control rack in the direction of the increasing of speed in a high speed range is very small (reverse Angleich amount $H<2$), the reverse Angleich amount required for the CPV-employed fuel injection mechanism (for example, $H>5.0$) cannot be satisfied. Therefore, there is a great demand for a novel governor with a significant change in design.

SUMMARY OF THE INVENTION

The purpose of the present invention is to provide a centrifugal force governor for a fuel injection pump, wherein a reverse Angleich characteristic such as shown in FIG. 4 with a broken line can be arbitrary obtained when applied to an RSV type, the lever ratio $k_i$ of the reverse Angleich characteristic can be set at high, whereby to be able to increase the degree of freedom in design.

According to a preferred embodiment of the present invention, there is provided a centrifugal force governor for a fuel injection pump comprising: a fly weight driven by a centrifugal force in accordance with the rotation number of the fuel injection pump; a control block movable in an axial direction in accordance with a movement of the fly weight; a guide lever, one end of which is rotatably connected to the control block via a fulcrum A, and the other is rotatably supported by a fulcrum B; a tension lever, one end of which is rotatably supported by the fulcrum B and the other is urged toward the control block by means of a force of a control spring; a control lever one end of which is rotatably supported by a fulcrum D and the other is connected to the control rack which controls an injection quantity of the fuel injection pump; a reverse Angleich lever one end of which is rotatably connected to the control block and the other is rotatably connected to a mid-portion of the control lever via a fulcrum C; a spring for attracting the reverse Angleich lever toward the guide lever; a stopper pin provided in the middle of the reverse Angleich lever; an abutting member, provided on the tension lever, to which the stopper pin detachably abuts when the reverse Angleich lever is moved by a predetermined amount; and an Angleich adapter provided on the tension lever such as to face the control block, and pressed against the control block by the Angleich spring.

Regarding the governor having the above-described structure, in accordance with the amount of movement of the control block moved in the axial direction in accordance with the fly weight, the moving amount of the lower portion of each of the guide lever and the reverse Angleich lever is varied, in the high speed rotation region. As each lever moves to the point where the stopper pin provided on the reverse Angleich lever abuts to the abut member provided on the tension lever, the reverse Angleich lever is stopped, and cannot be rotated any longer. When the rotation number further increases in the above status, the fulcrum C for connecting the reverse Angleich lever and the control lever together, is separated from the guide lever as resisting to the force of the spring, and the control lever rotates in the counter-clockwise direction around the fulcrum D. Consequently, the control rack is pushed to the pump side and moved to the position where the fuel injection quantity is increased.

DETAILED DESCRIPTION OF THE PREFERRED EMBODIMENTS

FIGS. 1 through 6 show a governor according to the first embodiment of the present invention.

Figure 1:
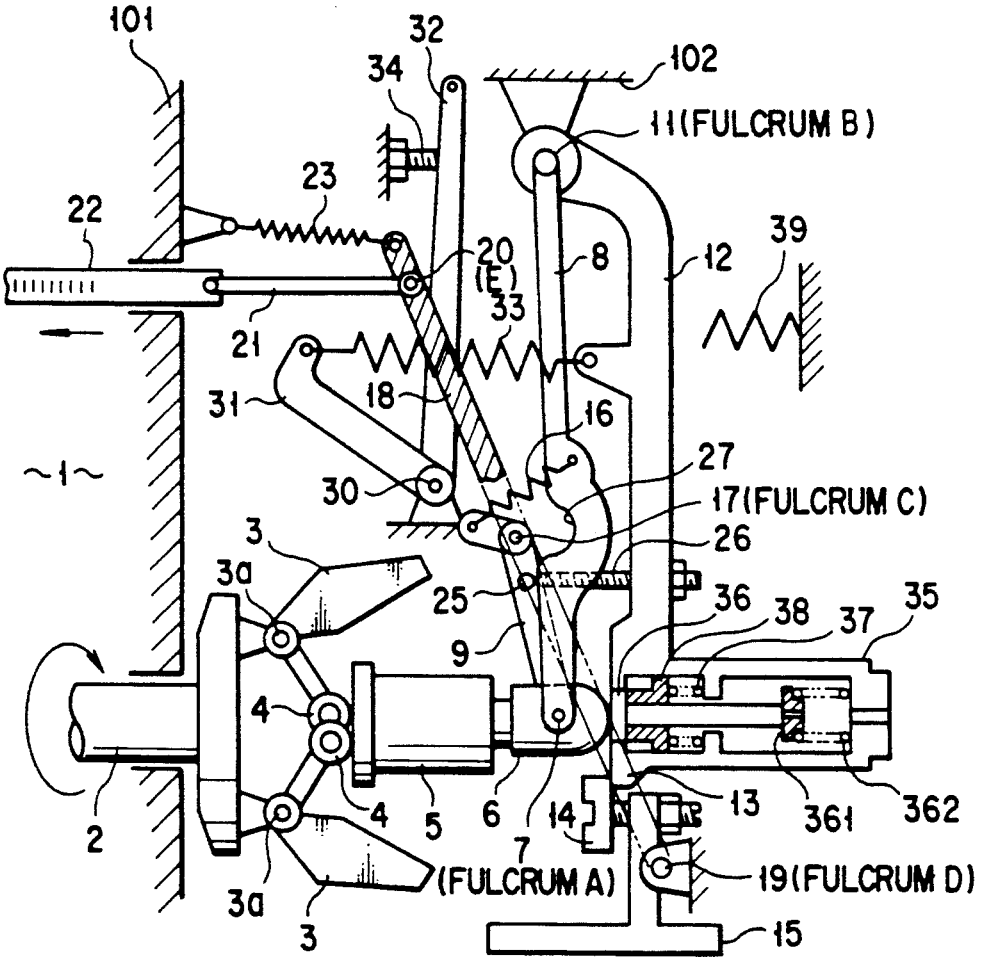
FIG. 1 is a diagram showing the first embodiment in which the present invention is applied to an RSV type governor, in a high-speed rotation state.

This embodiment is based on an RSV type governor, and as shown in FIG. 1, includes a fuel injection pump 1, which is not illustrated in detail, a cam shaft 2 for reciprocating a plunger of the rue]injection pump 1. The cam shaft 2 runs through a governor housing 101, and is introduced in a space defined by the governor housing 101 and a governor cover 102.

In the cam shaft 2, two centrifugal type fly weights 3, which are the rotation portion of the governor, are provided. Each of the fly weights 3 is rotatable around the weight supporting shaft 3*a*. when the fly weights 3 opens outward, a rollers 4 provided at the end portion of the arms of the fly weights abut to the edge surface of the governor sleeve 5, push the governor sleeve 5 in the right-hand side direction.

The governor sleeve 5 is connected to the control block 6 via bearings which are not shown in the figure so that the control block 6 does not rotate even if the governor sleeve 5 rotates. When the governor sleeve 5 is pushed by the rollers 4, the governor sleeve 5 and the control block 6 integrally moves in the axial direction. The other edge surface of the control block 6 is curved, and abuts to the end surface of the Angleich adapter 36 which will be described later.

To the control block 6, rotatably connected are a guide lever 8, and a reverse Angleich lever 9, which is a feature of the invention, via a common support pin 7 (fulcrum A).

The upper end of the guide lever 8 is rotatably connected to a lever support shaft 11 (fulcrum B) provided at the upper portion of the governor cover 102. To the lever support shaft 11, also rotatably connected is the upper end of the tension lever 12. A projection 13 is formed at the lower end of the tension lever 12 such that the projection 13 detachably abuts to a full-load stopper 14. The full-load stopper 14 controls the clockwise rotation of the tension lever 12. The full-load stopper 14 is engaged with the stay 15 such that the projecting amount can be adjusted.

To the control block 6, rotatably connected is the lower end of the reverse Angleich lever 9 also by the common support pin 7 (fulcrum A). A spring 16 is stretched over between the upper end of the reverse Angleich lever 9 and the mid-portion of the guide lever 8 such that the upper end of the reverse Angleich lever 9 is pulled in the direction of the guide lever 8. The mid-portion of the reverse Angleich lever 9 is rotatably connected to the mid-portion of the control lever 18 via a common pivotal pin 17 (fulcrum C).

The lower end of the control lever 18 is rotatably set to the lever support shaft 19 (fulcrum D) provided on the lower portion of the governor cover 102, and the upper end thereof is connected to a shackle 21 via a support pin 20 (fulcrum E). The shackle 21 is connected to the control rack 22 which adjusts the fuel injection quantity of the fuel injection pump 1.

The control rack 22 serves to increase the fuel injection quantity when moves to the left hand side the figure, pushed to the pump 1 side, or decrease the injection quantity when moves to the right hand side, pulled to the governor cover side.

One end of the start spring 23 is hooked on the upper end of the control lever 18, and the other end of the spring 23 is connected to the governor housing 101. The control lever 18 is urged by the start spring 23 in the counter-clockwise direction, so as to push the control rack 22 to the fuel injection increasing side.

The force of the spring 16 stretched over between the upper end of the reverse Angleich lever 9 and the mid portion of the guide lever 8 is set to be several times larger than that of the start spring 23.

Figure 5:
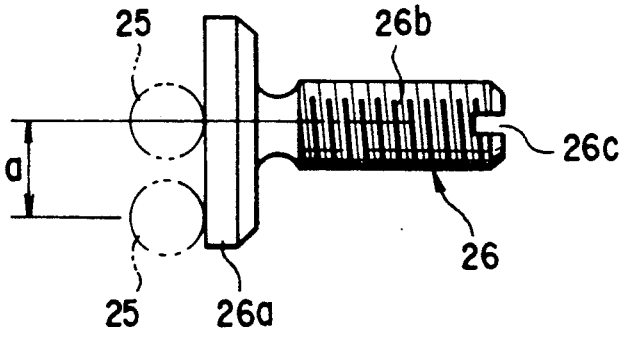
FIG. 5 is a diagram showing the structure of the adapter screw of the same embodiment.

On the reverse Angleich lever 9, a stopper pin 25 having a circular cross section, which is a feature of the invention, is located between the common support pin 17 (fulcrum A) and the pivotal pin 17 (fulcrum C). At a mid portion of the tension lever 12 facing to the stopper pin 25, there is provided an adapter screw 26, which is an abut member to which the stopper pin 25 can abut. As shown in FIG. 5, the adapter screw 26 has a collar portion 26*a* cutting worked to have a large flat surface, and further treated by heat process, formed at one end of the screw which faces the stopper pin 25, a screw portion 26*b* to be screwed into the tension lever 12 at a middle portion, and a groove 26*c* which engages with a screw driver for a screwing operation, at the other end.

With its structure, the amount of projection of the adapter screw 26 from the tension lever 12 can be adjusted. Accordingly, the distance between the collar portion 26*a* of the adapter screw 26 and the stopper pin 25 can be adjusted. As the reverse Angleich lever 9 rotates to approach the tension lever 12, the stopper pin 25 eventually abuts to the collar portion 26*a* of the adapter screw 26. After that, the distance between the reverse Angleich lever 9 and the tension lever 12 is maintained at constant even if the reverse Angleich lever 9 further rotates. By adjusting the projecting amount of the adapter screw 25 from the tension lever 12, the timing for abutting the stopper pin 25 to the adapter screw 26 can be varied.

In the mid-portion of the guide lever 8, a recess 27 for receiving the pivotal pin 17 (fulcrum C), is formed. A swiveling lever 31 is rotatably set on the governor cover 102 via the support pin 30. The support pin 30 runs through the governor cover 102, and an adjusting lever 32 is connected to the end portion of the pin 30 which is located outside the governor cover 102. The adjusting lever 32 and the swiveling lever 31 are integrally connected to each other via the common support pin 30, and therefore, as the adjusting lever 32 rotates, the swiveling lever 31 accordingly rotates.

A control spring 33 is stretched between the distal end of the swiveling lever 31 and the mid portion of the tension lever 12. The control spring 33 urges the tension lever 12 to rotate in the clockwise direction. When the swiveling lever 31 is rotated around the support pin 30 in the counter-clockwise direction by rotating the adjusting lever 32, the distal end of the swiveling lever 31 moves away from the tension lever 12. Consequently, the tension of the control spring 33 rises, thereby increasing the force to urge the tension lever 12 in the clockwise direction. As the force increases, the projection 13 in the lower end of the tension lever 12 abuts to the full-load stopper 14. In the case where the adjusting lever 32 is operating in the full-load side, the operation is limited by the maximum speed stopper 34 formed on the governor cover 102.

An idle spring 39 is set on the mid portion of the tension lever 12 so as to press the lever 12 in the clockwise direction.

An Angleich holder 35 is formed at the lower portion of the tension lever 12, and an Angleich adapter 36 is set in the Angleich holder 35. The Angleich adapter 36 is movably supported by the Angleich holder 35 in the axial direction of the control block 6. The inner diameter portion of the rod collar 38 is slidably fit to the portion of the rod which is connected to the Angleich adapter 36. The Angleich adapter 36 and the rod collar 38 are pressed by the Angleich spring 37 in the direction toward the control block 6.

In the Angleich holder 35, a spring receiving plate 361 is provided at the distal end of the rod portion of the Angleich adapter 36, and the spring receiving plate 361 is pushed by the adapter spring 362 in the axial direction of the Angleich adapter 36. The Angleich adapter 36 is pushed by the Angleich spring 37 and the adapter spring 362 in the direction toward the control block 6. Even if the rod collar 38 is stopped by the opening end of the Angleich holder 35, the pressing force of the adapter spring 362 is still working on the Angleich adapter 36 so that the Angleich adapter 36 is sliding in the rod collar 38 in the direction toward the control block 6 to project.

The operation of the reverse Angleich governor according to the above embodiment will be described in steps of the driving state.

(FIG. 2)

Figure 2:
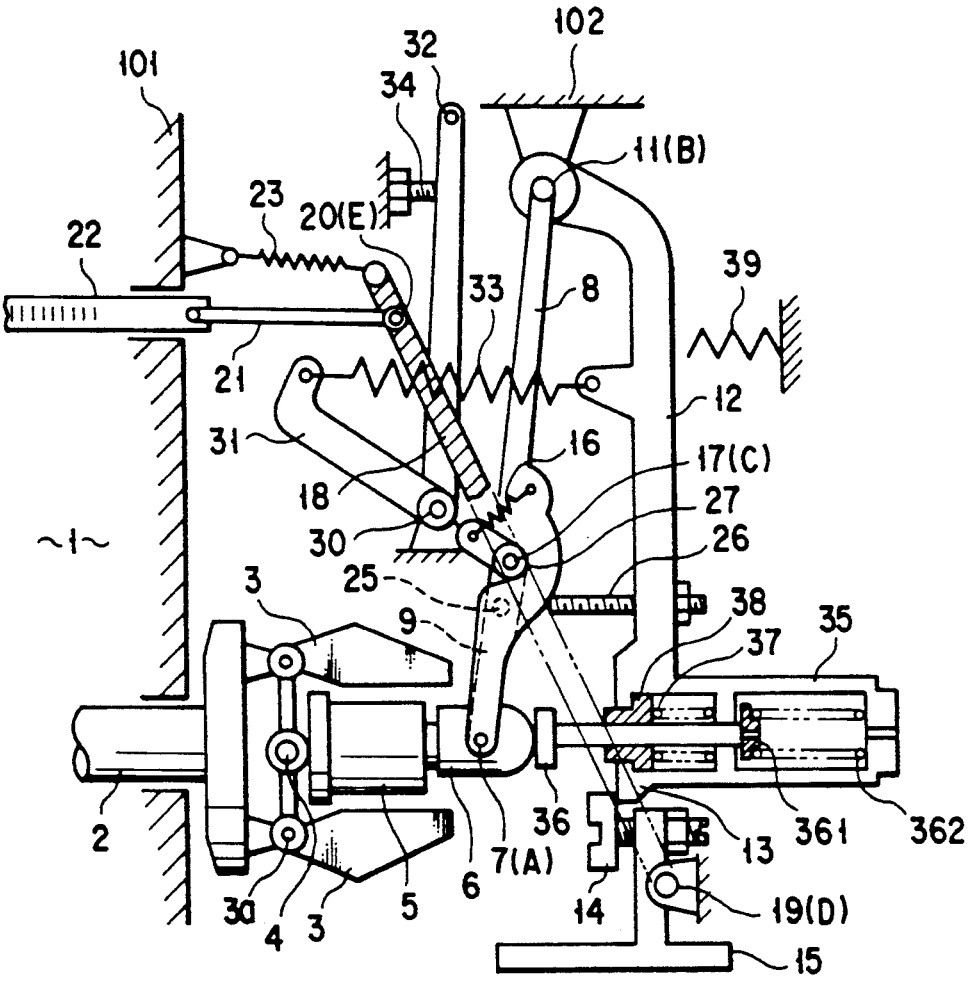
FIG. 2 is a diagram showing the same embodiment in the state before the start of the operation.

The state of the engine at the start of its operation is as shown in FIG. 2. The adjusting lever 32 is already moved to the start position where the lever abuts to the maximum speed stopper 34, and the swiveling lever 31 stretches out the control spring 33. Consequently, the tension lever 12 is rotated in the clockwise direction, and the projection 13 formed at the lower end of the tension lever 12 abuts to the full-load stopper 14.

Figure 4:
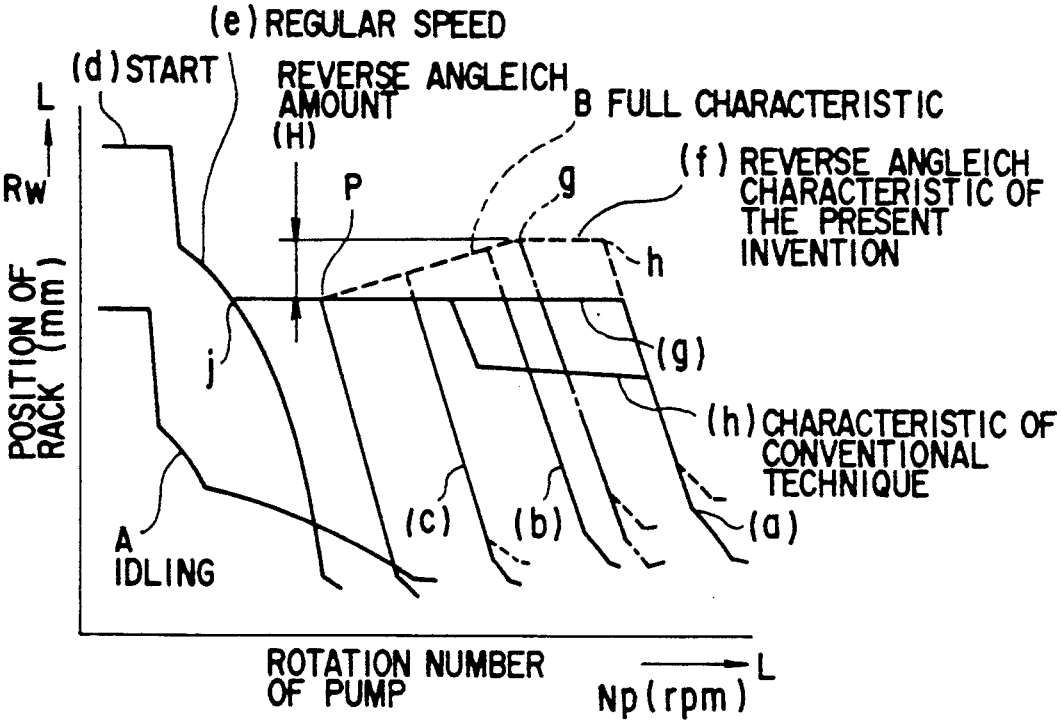
FIG. 4 is a graph showing the governor characteristics of the same embodiment.

At this time, a pair of fly weights 3 have not yet moved, and therefore the start spring 23 urges the control lever 18 in the counter-clockwise direction, and the Angleich adapter 36 being pushed by the adapter spring 362 is pushing the control block 6. Consequently, the control block 6 moves to the left-hand side, away from the tension lever 12. Since the control block 6 is located on the left hand side, the common support pin 7 (fulcrum A) is located on the left hand side, and so is the lower end of the guide levee 8. The recess 27 formed on the guide lever 8 is pressing the pivotal pin 17 to the left hand side, and therefore the control lever 18 is pivoted around the lever support shaft 19 (fulcrum D) in the counter-clockwise direction. Further, the control lever 18 is pulled by the start spring 23 having a weak tension force, and therefore the upper end portion of the lever is pulled to the left hand side, pushing the control rack 22 to a position on the pump 1 side. This position is the full-load position of the control rack 22, where a large quantity of fuel required to start the engine shown in FIG. 4, is required. In other words, the control rack is already pushed to the position indicated by (d) in FIG. 4, and the engine can be started easily by operating the starter.

(FIG. 3)

Figure 3:
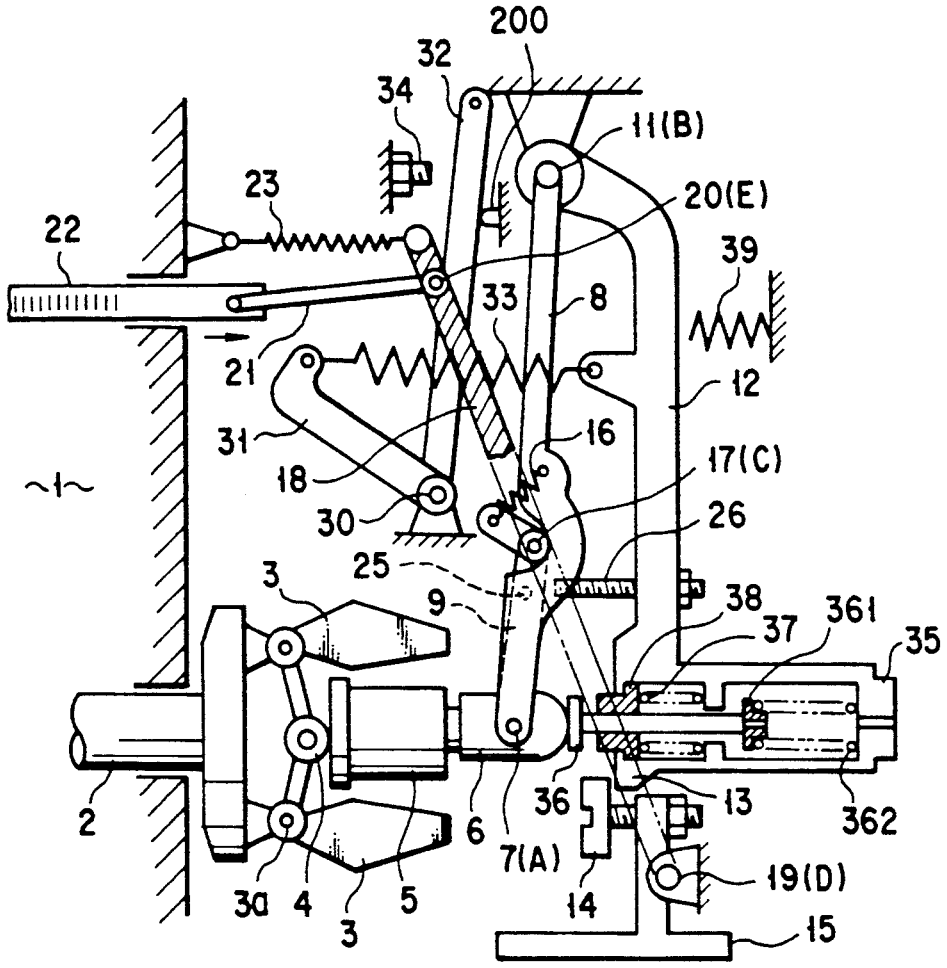
FIG. 3 is a diagram showing the same embodiment in the state of the idling operation.

When the engine is started, the adjusting lever 32 is rotated to the idling position 200 shown in FIG. 3. In accordance with the rotation of the cam shaft 2, the fly weights 3 are rotated, and the centrifugal force generated by the rotation opens the fly weights 3 outward, so that the control block 6 is moved by the rollers 4 in the right hand side direction. As the control block 6 moves to the right hand side, the Angleich adapter 36 and the adapter spring 362 are pushed in the right hand side direction. Further, the common support pin 7 (fulcrum A) also moves to the right hand side, and the guide lever 8 is rotated around the lever support shaft 11 (fulcrum B) in the counter-clockwise direction. As the guide lever 8 rotates, the reverse Angleich lever 9 pulled by the spring 16 toward the guide lever 8 moves integrally with the guide lever 8. Thus, the pivotal pin 17 (fulcrum C) moves to the right hand side while abutting to the recess 27 formed on the guide lever 8. Since the pivotal pin 17 is engaged to the mid portion of the control lever 18, the control lever 18 rotates around the lever support shaft 19 (fulcrum D) in the clockwise direction, as the pivotal pin 17 (fulcrum C) moves to the right hand side. As mentioned before, the force of the spring 16 is set several times larger than that of the start spring 23, therefore the reverse Angleich lever 9 moves integrally with the guide lever 8, and the control lever 18 rotates in spite of the force of the start spring 23. Thus, the upper end of the control lever 18 moves to the right hand side direction, and the control rack 22 is pulled out to the governor cover 102 side by the shackle 21, and moved to the idling position.

The control rack 22 is stopped at the position where the thrust generated by the centrifugal force of the weights 3, the tension force of the start spring 23 having a weak tension, and the synthesizing force of the idle spring 39 and the adapter spring 362 are balanced, so that a smooth idling rotation is kept.

When the rotation number of the engine reduces, the centrifugal force of the fly weights 3 decreases, and the weights 3 close inward. Therefore, the control block 6 moves to the left hand side, due to which the lower end of the guide lever 8 moves to the left hand side, so that the pivotal pin 17 (fulcrum C) moves to the left hand side. Accordingly, the upper end of the control lever 18 moves to the left hand side. The control rack 22 then moves to the left hand side, i.e. in the direction for increasing the fuel injection quantity.

In contrast, when the rotation number of the engine rises, the centrifugal force of the fly weights 3 increases. Therefore, the control block 6 pushes the Angleich adapter 36 to the right hand side in spite of the force of the adapter spring 362. As the control block moves to the right hand side, the lower end of the guide lever 8 moves to the right hand side, and so does the pivotal pin 17 (fulcrum C). Thus, the upper end of the control lever 18 moves to the right hand side, and the control track 22 moves to the right hand side, in the direction for decreasing the fuel injection.

As described above, the governor operates automatically, maintaining a constant idling rotation as indicated by letter A in FIG. 4.

(FIG. 3)

When the rotation number of the engine increases from the above idling drive state, the centrifugal force of the fly weights 3 becomes large accordingly. Consequently, the control block 6 pushes the Angleich adapter 36 in spite of the resisting force of the adapter spring 362. Thus, the control block 6 moves to the right hand side further from the position for the above idling drive.

As described in connection with the idling, the common support pin (fulcrum A) moves to the right hand side, so that the guide lever 8 is rotated around the lever support shaft 11 (fulcrum B) in the counter-clockwise direction. In the meantime, the reverse Angleich lever 9 moves to the right hand side while the pivotal pin 17 (fulcrum C) abutting to the recess 27 formed on the guide lever 8. When the pivotal pin 17 (fulcrum C) moves to the right hand side, the control lever 18 is rotated around the lever support shaft 19 (fulcrum D) in the clockwise direction, so that the upper end of the control lever 18 moves to the right hand side. Therefore, the control rack 22 is pulled out to the governor cover 102 side by the shackle 21, and is moved to the position for decreasing the fuel injection quantity.

As to the driving state of a regular speed when the adjusting lever 32 is shifted from the idling position (FIG. 4) to the full position, the control rack 22 is moved in the direction for decreasing the fuel injection quantity, creating the operation of a so-called positive Angleich characteristic, as shown in FIG. 4 (*e*).

When the rotation number of the engine lowers in the above state, the centrifugal force of the fly weights 3 decreases, so that moving the control block 6 moves to the left hand side. Along with the movement of the control block 6, the lower end of the guide lever 8 moves to the left hand side, the pivotal pin 17 (fulcrum 17) moves to the left hand side, and the upper end of the control lever 18 moves to the left hand side. Consequently, the control rack 22 moves to the left hand side, i.e. in the direction of increasing the fuel injection quantity, so that the rotation number of the engine is increased.

In contrast, when the rotation number of the engine rises, the centrifugal force of the fly weights 3 increases. Therefore, the control block 6 moves the Angleich adapter 36 to the right hand side in spite of the resisting force of the adapter spring 362. Along with this movement, the lower end of the guide lever 8 also moves to the right hand side, the pivotal pin 17 (fulcrum C) moves to the right hand side, and the upper end of the control lever 18 moves to the right hand side. Consequently, the control rack 22 moves to the right hand side, i.e. in the direction of decreasing the fuel injection quantity, so that the rotation number of the engine is decreased.

Thus, the governor automatically operates at a constant regular rotation as indicated by (*e*) in FIG. 4.

(FIG. 1)

The adjusting lever 32 of the governor is set at the full-load position, i.e. the position where the lever abuts to the maximum speed stopper 34, and the projection 13 of the tension lever 12 abuts to the full-load stopper 14.

When the rotation number of the engine exceeds a predetermined one in this state, and reaches in the high speed rotation region, the centrifugal force of the fly weights 3 increases from that of the regular driving. Therefore, the control block 6 moves the Angleich adapter 36 in spite of the resisting force of the adapter spring 362, moving the control block 6 further to the right hand side.

Similar to the case of the regular drive mentioned above, as the control block 6 moves to the right hand side, the lower end of the guide lever 8 moves to the right hand side. The reverse Angleich lever 9, which is attracted toward the guide lever 8 by the spring 16, is also integrally moved while the pivotal pin 17 (fulcrum C) abutting to the recess 27 formed on the guide lever 8.

When the movement amount of the pivotal pin 17 (fulcrum C) in the right hand side direction reaches a predetermined distance (high speed rotation), the stopper pin 25 formed on the reverse Angleich lever 9 abuts to the collar portion 26*a* of the adapter screw 26 mounted to the tension lever 12.

As the stopper pin 25 abuts to the adapter screw 26, the clockwise rotation of the reverse Angleich lever 9 is blocked, more specifically, the movement of the pivotal pin 17 (fulcrum C) to the right hand side is blocked. The abutting point between the stopper pin 25 and the adapter screw 26 (fulcrum F, see FIG. 6) is biased from the pivotal pin 17 (fulcrum C) to the lever support shaft 19 (fulcrum D) side. Therefore, if the control block 6 moves further to the right hand side, i.e. the rotation number further increases, the weight thrust becomes larger than the set load of the Angleich spring 37. Thus, the pivotal pin 17 (fulcrum C) moves to the left hand side with respect to the abutting point F between the stopper pin 25 and the adapter screw 26.

In other words, when the stopper pin 25 abuts to the adapter screw 26, and the control block moves further to the right hand side, the common support pin 7 (fulcrum A) of the reverse Angleich lever 9 rotates around the abutting point (fulcrum F, see FIG. 6) in the counter-clockwise direction. Consequently, the pivotal pin 17 (fulcrum C) moves away from the recess 27 formed on the guide lever 8, and the pivotal pin 17 (fulcrum C) rotates around the common support pin 19 in the counter-clockwise direction.

As the pivotal pin 17 (fulcrum C) rotates, the control lever 18 rotates around the lever support shaft 19 (fulcrum D) in the counter-clockwise direction, and the upper end thereof moves to the left hand side. Consequently, the control rack 22 is pressed to the pump 1 side via the shackle 21, and moved to the position for increasing the fuel injection quantity.

In short, in a high speed rotation such that the stopper pin 25 abuts to the adapter screw 26, the fuel injection pump 1 is controlled so as to increase the injection quantity, exhibiting the reverse Angleich characteristic (trace j-P-g-h of the full characteristic B) indicated by the broken line in FIG. 4.

When the rotation number further increases after the stopper pin 25 abuts to the adapter screw 26, the control block 6 presses the Angleich adapter 36 in spite of the resisting force of the adapter spring 362. As the control block 6 presses the Angleich adapter 36 to abut to the rod collar 38, the force of the Angleich spring 37, in addition to the force of the adapter spring 362, acts on the Angleich adapter 36.

When the rotation number further increases in the above state, the control block 6 presses the Angleich adapter 36 in spite of the synthesized force of the adapter spring 362 and the Angleich spring 37. When the rotation number further increases, the tip end of the control block 6 abuts directly to the tension lever 12.

During the time period from the stopper pin 25 abuts to the adapter screw 26, until the tip end of the control block 6 abuts directly to the tension lever 12, the reverse Angleich effect is achieved. The effect is called reverse Angleich stroke ($S_t$).

When the rotation number further increases after the distal end of the control block 6 abuts to the tension lever 12, the control block 6 moves to the right hand side, and the tension lever 12 is pushed in spite of the strong urging force of the control spring 33. Consequently, the tension lever 12 rotates in the counter-clockwise direction such that the projection 13 of the lever moves away from the full-load stopper 14.

As the control block 6 moves to the right hand side, the guide lever 8 rotates in the counter-clockwise direction. Consequently, the tension lever 12, the guide lever 8, and the fulcrum A of the reverse Angleich lever 9 are integrally rotated around the lever support shaft 11 (fulcrum B) in the counter-clockwise direction. Thus, the pivotal pin 17 (fulcrum C) moves to the right hand side with respect to the lever support shaft 19 (fulcrum D), and the upper end of the control lever 18 moves to the right hand side. Thus, the control rack 22 is pulled out to the governor cover 102 side by the shackle 21, reducing the fuel injection quantity. As the rotation number further increases, the injection quantity is reduced, eventually to the stopping region.

The reverse Angleich characteristic shown in FIG. 4 take a reverse Angleich amount H, and the reverse Angleich amount H can be obtained by multiplying the reverse Angleich stroke ($S_t$) (=the moving amount of the control block 6 during the reverse Angleich operation) by the lever ratio ($k_1$), $$H = S_t \times k_i \quad (1)$$

Figure 6:
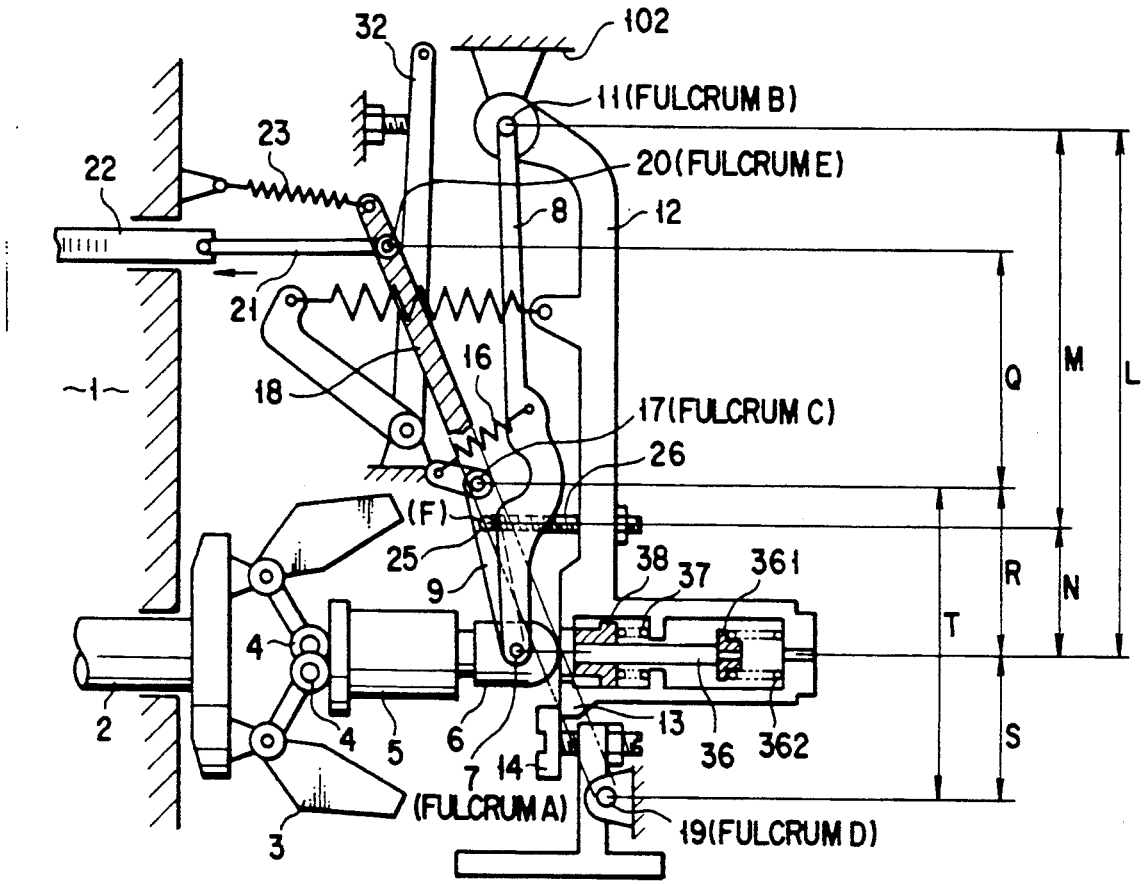
FIG. 6 is a diagram showing the measurements between fulcrums of the same embodiment.

The lever ratio ($k_1$) can be obtained by the following calculating formula with the measurements shown in FIG. 6.

The lever ratio ($k_1$) of the reverse Angleich can be obtained from:

$$k_i = \{(Q+T) / T\} \times \{(R-N) / N\} \quad (2)$$

where

L=height between fulcrums A and B
M=height between fulcrums B and F
N=height between fulcrums A and F
Q=height between fulcrums E and C
R=height between fulcrums A and C
S=height between fulcrums A and D
T=height between fulcrums C and D
and L=M+N, and
T=R+S.

The lever ratio ($k_{i2}$) of the regular Angleich characteristic can be obtained from the following formula:

$$k_{i2} = \{(Q+T) / T\} \times (L-R) / L.$$

The reverse Angleich amount H shown in FIG. 4 can be obtained by substituting the formula (1) for the formula (2).

In FIG. 4, a starting timing point P of the reverse Angleich effect can be set by adjusting the projection amount of the adapter screw 26 so as to change the timing of abutting to the stopper pin 25. Thus, the timing of abutting to the stopper pin 25 varies as the projection amount of the adapter screw 26 changes. That is, a measurement N shown in FIG. 6 changes. However, at the distal end of the adapter screw 26, the collar portion 26a having a large area is formed as shown in FIG. 5. With this structure, even if the projection amount of the adapter screw 26 changes, the stopper pin 25 can surely abut to the adapter screw 26 in the range a, so that the degree of freedom in designing the reverse Angleich lever 9 increases.

The slope of the reverse Angleich characteristics shown in FIG. 4 can be varied by changing the spring characteristic specification of the adapter spring 37.

By use of the above-described governor, the fuel injection quantity can be easily corrected based on the reverse Angleich characteristic indicated by the broken line in FIG. 4 in the CPV-employed fuel injection mechanism, or the fuel injection mechanism having a nozzle with a squeezed injection hole, even if the fuel injection pump has a pump characteristic in which the injection quantity decreases in a high speed rotation region.

Further, the reverse Angleich amount H can be obtained from the formula, $H=S_f \times k_i$, and the value of the reverse Angleich amount H can be set large. The following is a comparison of setting the value of the reverse Angleich amount H, to the conventional reverse Angleich governor.

Figure 7:
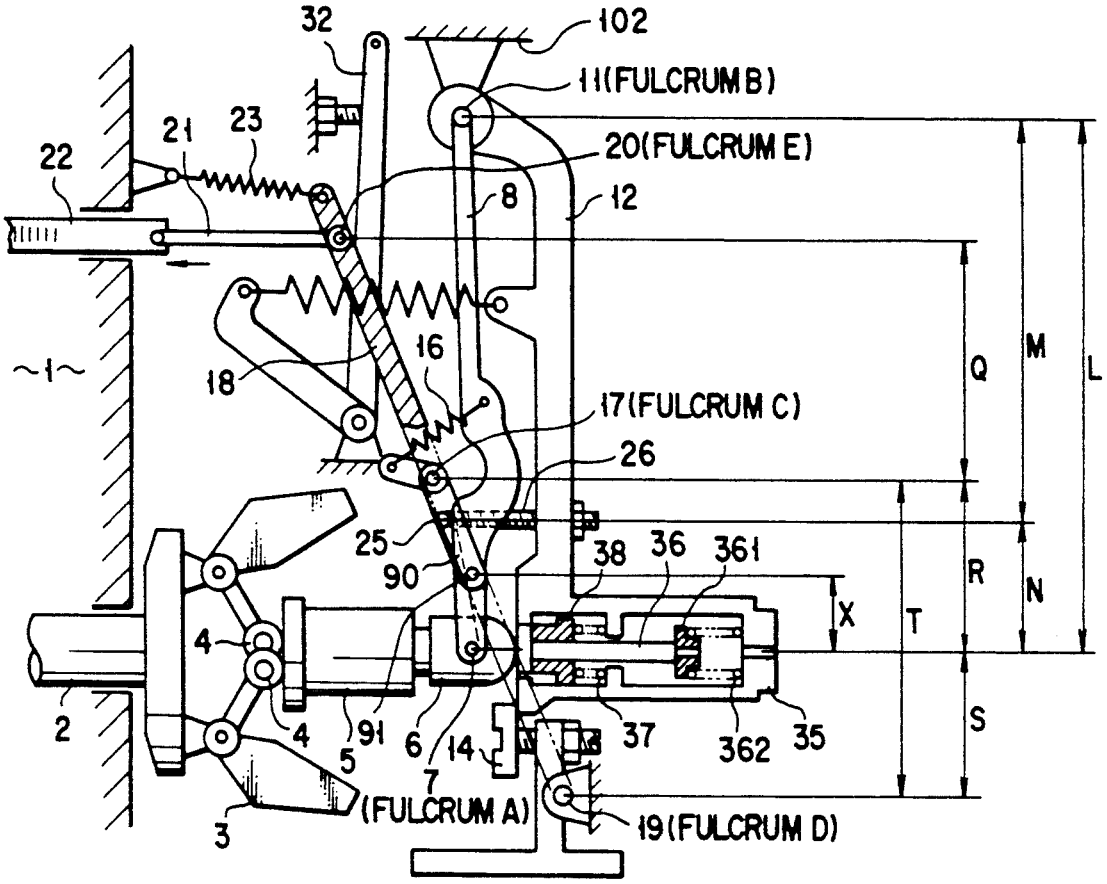
( PRIOR ART ) F I G. 7
FIG. 7 is a diagram showing the measurements between fulcrums of the conventional governor disclosed in Jpn. Pat. Appln. KOKOKU Publication No. 52-8449.

FIG. 7 shows a structure of a reverse Angleich governor involving the technical idea disclosed in Jpn. Pat. Appln. KOKOKU Publication No. 52-8449. As shown in this figure, a link lever 90, which corresponds to the reverse Angleich lever 9 of the present invention, and one end of which is pivotally jointed to the mid-portion of the guide lever 8 via a support pin 91, and the other end is pivotally jointed to the control lever 18 via the pivotal pin 17 (fulcrum C). The distance between the supporting point (pin 91) of the link lever 90 and the supporting point (point A) of the guide lever 8 is expressed by X shown in FIG. 7.

As to the governor shown in FIG. 7, the lever ratio $k_i'$ can be obtained from the following formula:

$$k_i'=\{(Q+T)/T\}\times\{(M/(M+N)\}\times\{(R-X)/(N-X)\} \quad (3)$$

As is clear from the comparison between the formulas (2) and (3), the governor of the present invention has a large reverse Angleich lever ratio, and therefore the value of the reverse Angleich amount H can be set large. Therefore, the movement of the control rack, which cannot be realized with the conventional reverse Angleich governor, can be realized, thereby satisfying a large reverse Angleich amount required in the CPV-employed fuel injection mechanism, or the injection mechanism having a nozzle with a squeezed hole.

Further, according to the structure shown in FIG. 7, when the lever ratio is increased, the adapter screw 26 and the Angleich holder 35 approach to each other, as indicated by the formula (3). Since the screw and the holder interfere with each other, the lever ratio cannot be set large.

According to the structure of the present invention, the reverse Angleich lever 9 is connected to the control block 6, and therefore the ratio of the movement distance of the reverse Angleich lever 9 can be set large. Consequently, the lever ratio can be set large, and even at a large lever ratio, the adapter screw 26 and the Angleich holder 35 do not interfere with each other.

The reverse Angleich amount H for the conventional automobile is about 1.5–2.0 mm, whereas that of the present invention can be set as larger as 5.0 mm, which is effective in the case of the high pressure injection. Since the above effect can be obtained by a little bit of remodeling, there is no need to provide a novel governor.

When the tension force of the control spring 33 is varied by changing the position of the adjusting lever 32, the governor characteristics (a), (b), (c) ... in several application ranges as shown in FIG. 4 can be obtained.

The present invention is not limited to the first embodiment shown in FIGS. 1 through 6, and can be remodeled as illustrated in FIGS. 8 through 11.

In the second embodiment, a supporting lever 40 is rotatably jointed to a tension lever 12 around a fulcrum 41, and to the supporting lever 40, jointed is a lever support shaft 19 (fulcrum D) at the lower end of the control lever 18. One end of a load adjusting lever 43 is jointed to the mid-portion of the supporting lever 40 by a fulcrum 42, and the other end of the load adjusting lever 43 is rotatably jointed to the governor cover 102 around a fulcrum 44.

The rest of the structure is similar to that of the governor shown in FIG. 1, and therefore the elements are referred to by the same reference numbers, and the explanation thereof will be omitted.

Figure 8:
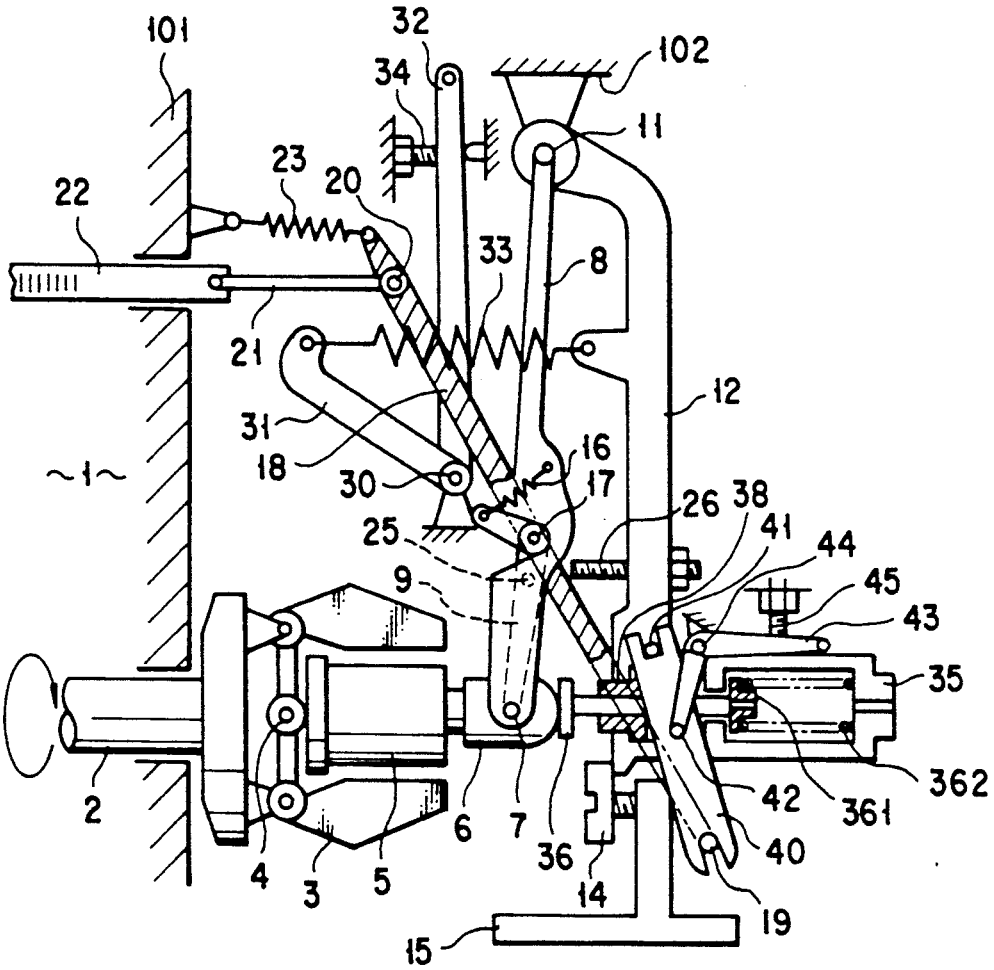
FIG. 8 is a diagram showing the second embodiment in which the present invention is applied to another type of governor, in the state before the start of the operation.
Figure 9:
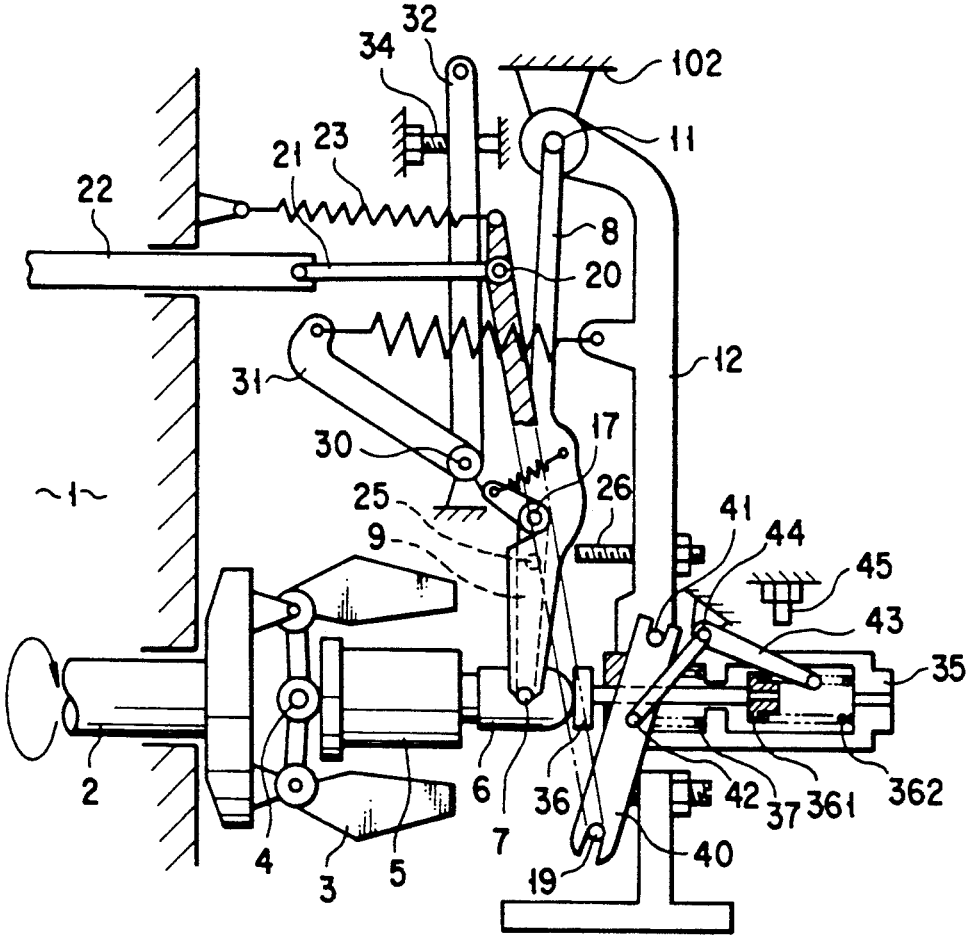
FIG. 9 is a diagram showing the same embodiment in the state of the idling operation.
Figure 10:
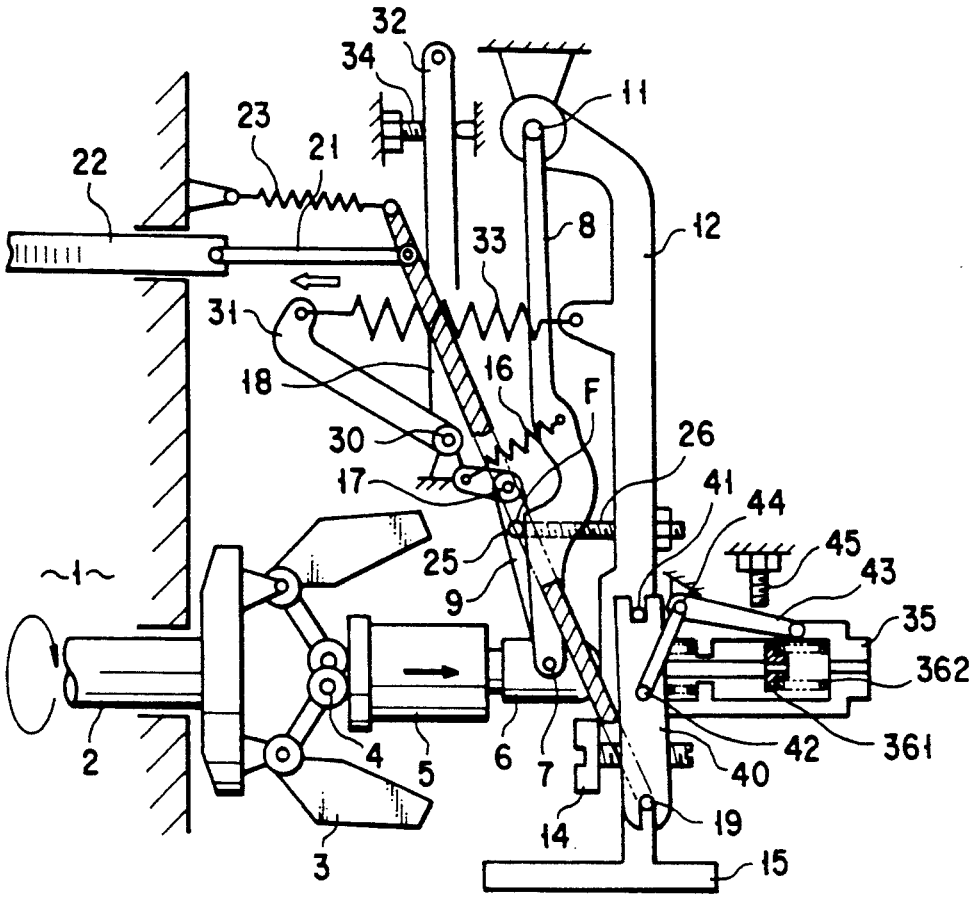
FIG. 10 is a diagram showing the same embodiment in a high speed driving state.

At the start of the engine, the load adjusting lever 43 is at the position where the lever abuts to the stopper 45 as shown in FIG. 8, and the supporting lever 40 is rotated around the fulcrum 41 in the counter-clockwise direction. Thus, the lower end of the control lever 18 is swung to the right hand side, and the control lever 18 rotates around the pivotal pin 17 (fulcrum C). Accordingly, the upper end of the control lever 18 moves to the left hand side, pushing the control rack 22 in the direction for increasing the fuel injection quantity.

In an idling drive, the load adjusting lever 43 moves in the clockwise direction to a position away from the stopper 45, and the supporting lever 40 rotates around the fulcrum 41 in the clockwise direction. Therefore, the lower end of the control lever 18 is swung to the left hand side, and the control lever 18 rotates around the pivotal pin 17 (fulcrum C). Accordingly, the upper end of the control lever 18 moves to the right hand side, shifting the control rack 22 in the direction for reducing the fuel injection quantity.

When the rotation number of the pump increases to a regular driving range in the state, the control block 6 moves to the right hand side by the effect of the fly weights 3, moving the lower end of the guide lever 8 to the right hand side. Along with such a movement, the reverse Angleich lever 9, which is attracted toward the guide lever 8 by the spring 16, moves to the right hand side, the pivotal pin 17 (fulcrum C) moves to the right hand side. Accordingly, the upper end of the control lever 18 moves to the right hand side, moving the control rack 22 in the direction for reducing the fuel injection quantity.

When the rotation number of the pump further increases to a high speed rotation region, the centrifugal force of each fly weight 3 increases. Therefore, the control block 6 moves the adapter 36 in spite of the resisting force of the idle spring 39, moving the control block 6 further to the right hand side. When the moving amount of the pivotal pin 17 (fulcrum C) in the right hand side direction reaches a predetermined distance, the stopper pin 25 formed on the reverse Angleich lever 9 abuts to the adapter screw 26 set on the tension lever 12.

As the stopper pin 25 abuts to the adapter screw 26, the movement of the pivotal pin 17 (fulcrum C) to the right hand side is stopped. When the control block 6 further moves to the right hand side, the pivotal pin 17 (fulcrum C) starts to move reversely to the left hand side with respect to the abutting point F between the stopper pin 25 and the adapter screw 26. In other words, when the stopper pin 25 abuts to the adapter screw 26, and the rotation number further increases, the control lever 18 rotates around the lever support shaft 19 (fulcrum D) in the counter-clockwise direction, and the upper end of the lever moves to the left hand side. Accordingly, the control rack 22 is pushed via the shackle 21 to the pump side, and moved to the position for increasing the fuel injection quantity.

For a high speed rotation such that the stopper pin 25 abuts to the adapter screw 26, the fuel injection pump 1 is controlled to increase the injection quantity, achieving the reverse Angleich characteristic.

Figure 11:
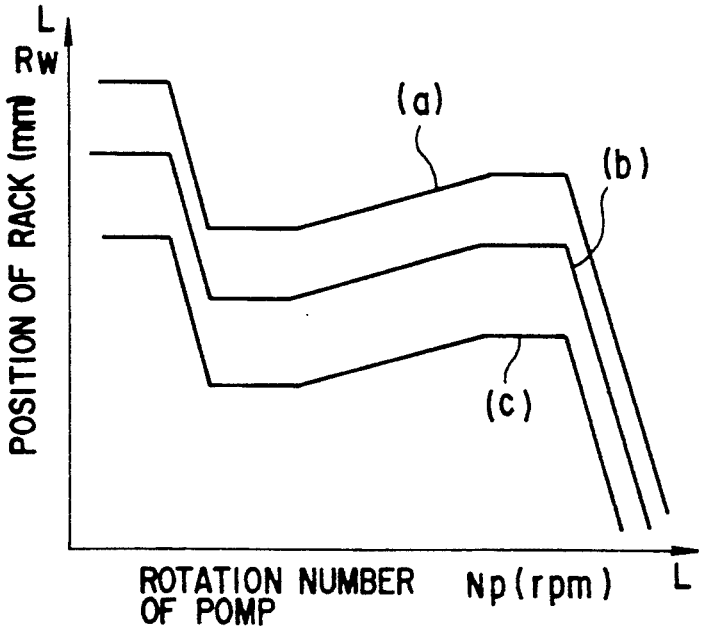
FIG. 11 is a diagram showing the governor characteristics of the same embodiment.

With the above case, when the load adjusting lever 43 is rotated by means of pedal or the like of the automobile, the rotating position of the control lever 18 changes, so that the governor characteristic in this case is as indicated by (a), (b), (c) shown in FIG. 11, exhibiting an M-M characteristic (maximum-minimum speed control characteristic) of parallel movement.

As described, according to the governor having all-speed characteristics of the present invention, in a high speed rotation region, the control block is moved in accordance with the movement of the fly weights, moving the guide lever and the lower end of the reverse Angleich lever. Accordingly, the stopper pin provided on the reverse Angleich lever abuts to the abut member formed on the tension lever. When the stopper pin abuts to the abut member, and the rotation number further increases, the control lever is rotated so as to push the control rack to the pump side. Consequently, the governor serves to control the injection quantity of the fuel injection pump, exhibiting the reverse Angleich characteristic indicated by the broken line in FIG. 4.

In the CPV-employed fuel injection mechanism used for decreasing NOx etc., requested by the exhaustion gas regulation, or the injection mechanism having a nozzle with a squeezed injection hole, it is effective to use the above-described governor for the injection pump having a tendency of decreasing the injection quantity as the rotation number of the injection pump increases. By use of the governor, such the tendency can be corrected. Further, the reverse angleich lever of the governor is jointed to the control block, and therefore the reverse Angleich amount can be set large. Thus, the degree of freedom in designing the reverse Angleich characteristic increases, and the reverse Angleich characteristic required by the injection mechanism can be sufficiently met. Consequently, the power of the engine can be raised, and it becomes easy to meet the requirement of a wide range of exhaustion, without conducting a great deal of change in parts.

The present invention is not limited to the above-described embodiments, and can be remodeled into several versions. The embodiments provided above are merely some of the typical examples, and should not be regarded in a limited sense. The scope of the present invention is recited in the claims, and the remodeling and/or revision of an embodiment all remain in the scope.

What is claimed is:

1. A centrifugal force governor with a governor cover, used for a fuel injection pump comprising:

a cam shaft for driving the fuel injection pump;

a fly weight provided for said cam shaft;

converting means for converting a centrifugal force of the fly weight generated by the rotation of the cam shaft, into a force in an axial direction;

a control block, provided in said converting means, moved in the axial direction in accordance with the centrifugal force of the fly weight, and having a fulcrum A;

a guide lever, one end of which is jointed to said control block by the fulcrum A, and the other end is supported by a fulcrum B provided on said governor cover, being rotatable around the fulcrum B in accordance with the movement of the control block;

a tension lever rotatably supported by the fulcrum B;

urging means for urging the tension lever around the fulcrum B, toward the control block;

a control lever, one end of which is rotatably supported by a fulcrum D, and the other is jointed to a control rack for controlling the injection quantity of the fuel injection pump, having a fulcrum C in a mid-portion thereof;

a reverse Angleich lever one end of which is jointed to said control block so as to move along therewith, and the other is jointed to the fulcrum C;

reverse Angleich lever urging means for urging said reverse Angleich lever toward the guide lever so that the reverse Angleich lever and the fulcrum C move along with the rotation of the guide lever; and shifting means provided between said reverse Angleich lever and said tension lever, for regulating the movement of said reverse Angleich lever when the centrifugal force of said fly weight reaches a predetermined value, and for shifting the control lever so that the injection quantity of said fuel injection pump increases by moving said reverse Angleich lever and said fulcrum C in spite of an urging force of said reverse Angleich lever urging means for achieving a reverse Angleich operation, when the centrifugal force exceeds the predetermined value.

2. A centrifugal force governor for a fuel injection pump, according to claim 1, wherein said shifting means includes a stopper pin provided in the mid-portion of said reverse Angleich lever, and an abut member, provided on said tension lever, for abutting to said stopper pin when the centrifugal force of said fly weight reaches the predetermined value.

3. A centrifugal force governor for a fuel injection pump, according to claim 2, wherein a reverse Angleich amount H of said centrifugal force governor, a moving amount $S_t$ of the control block during a reverse Angleich operation (reverse Angleich stroke), and a lever ratio $k_i$ satisfy the following:

$$H = S_t \times k_i \text{ and}$$

$$\text{the lever ratio } k_i = \{(Q+T) / T\} \times \{(R-N) / N\}$$

where E is a point of jointing the control rack and the control lever, F is a position of the stopper pin provided on the reverse Angleich lever, and the following measurements are taken along the radial direction of the control block, L=height between fulcrums A and B
M=height between fulcrums B and F
N=height between fulcrums A and F
Q=height between fulcrums E and C
R=height between fulcrums A and C
S=height between fulcrums A and D
T=height between fulcrums C and D and
L=M+N, and
T=R+S.

4. A centrifugal force governor for a fuel injection pump, according to claim 2, wherein said abut member includes adjusting means for adjusting a distance between the stopper pin and the abut member.

5. A centrifugal force governor for a fuel injection pump, according to claim 2, wherein said abut member has an end surface, and said stopper pin has an abut surface which is detachably abutted to said end surface, an area of said end surface being larger than that of said abut surface.

6. A centrifugal force governor for a fuel injection pump, according to claim 1, wherein a distal end of said tension lever has an Angleich adapter urged by the control block, said Angleich adapter defining a reverse Angleich stroke $S_t$ defined from the position of the control block where the centrifugal force of said fly weight reaches the predetermined value, to the position where the distal end of the control block abuts to the tension lever as the centrifugal force of the fly weight increases.

* * * * *